US006585138B2

(12) United States Patent
Takayama

(10) Patent No.: US 6,585,138 B2
(45) Date of Patent: Jul. 1, 2003

(54) DEVICE FOR SUPPLYING WRAP FILM

(76) Inventor: Yoshikazu Takayama, 19-5, Otsuka 5-chome Bunkyou-ku, Tokyo (JP)

( * ) Notice: Subject to any disclaimer, the term of this patent is extended or adjusted under 35 U.S.C. 154(b) by 0 days.

(21) Appl. No.: 10/234,561

(22) Filed: Sep. 3, 2002

(65) Prior Publication Data

US 2003/0006263 A1 Jan. 9, 2003

Related U.S. Application Data

(62) Division of application No. 09/743,620, filed as application No. PCT/JP00/03053 on May 12, 2000, now Pat. No. 6,520,395.

(30) Foreign Application Priority Data

May 14, 1999 (JP) ..... 11-134331

(51) Int. Cl.[7] ..... B26F 3/02; B65D 85/02

(52) U.S. Cl. ..... 225/41; 225/90; 242/588.3; 242/562.1

(58) Field of Search ..... 225/39–49, 90; 242/588.3, 562.1, 588.6, 562; 206/409

(56) References Cited

U.S. PATENT DOCUMENTS

| | | | | | |
|---|---|---|---|---|---|
| 2,751,163 | A | * | 6/1956 | Waltz | 225/47 |
| 3,156,356 | A | * | 11/1964 | McConnell | 206/409 |
| 3,851,809 | A | * | 12/1974 | McKibbin | 225/48 |
| 4,586,671 | A | * | 5/1986 | Piana et al. | 242/588.3 |
| 4,630,765 | A | * | 12/1986 | Samuelson et al. | 225/43 |
| 4,648,536 | A | * | 3/1987 | VanderLugt | 225/43 |
| 4,787,543 | A | * | 11/1988 | Fabo et al. | 225/43 |
| 5,121,839 | A | * | 6/1992 | Lapp | 225/48 |
| 5,146,828 | A | * | 9/1992 | Huang et al. | 225/43 |
| 5,186,376 | A | * | 2/1993 | Scharf et al. | 225/42 |
| 5,190,199 | A | * | 3/1993 | Bulger et al. | 225/50 |
| 5,222,644 | A | * | 6/1993 | Moreno | 225/43 |
| 5,947,360 | A | * | 9/1999 | Frank | 225/39 |
| 6,375,058 | B1 | * | 4/2002 | Passamoni | 225/49 |
| 6,520,395 | B1 | * | 2/2003 | Takayama | 225/41 |

FOREIGN PATENT DOCUMENTS

| | | |
|---|---|---|
| JP | 57-26329 | 2/1982 |
| JP | 8-183528 | 7/1996 |
| JP | 11-43141 | 2/1999 |

* cited by examiner

*Primary Examiner*—Allan N. Shoap
*Assistant Examiner*—Jason Prone
(74) *Attorney, Agent, or Firm*—Frommer Lawrence & Haug LLP; William S. Frommer

(57) ABSTRACT

According to this invention, in a device for supplying wrap film, by drawing out a wrap film from a wrap film container and cutting off, a user makes a sheetlike wrap film guide that has the property of adhering to the wrap film is adhered to the end part of the wrap film, and drawing out them in one body almost over the width. Thus the user can further easily, hygienically and safely cut the wrap film.

3 Claims, 11 Drawing Sheets

DEVICE FOR SUPPLYING WRAP FILM

This is a division of U.S. application Ser. No. 09/743,620 filed Jan. 11, 2001, now U.S. Pat. No. 6,520,395, which is based upon International Application PCT/JP00/03053, filed May 12, 2000.

TECHNICAL FIELD

This invention relates to a device for supplying wrap film, and more particularly, is applicable to cutting a wrap film for necessary amount from a container to use when wrapping, storing or cooking food etc., or the like.

BACKGROUND ART

Heretofore, as this kind of wrap films, for example, as shown in FIG. 22, a wrap film body 11 is contained in a box-type container 20 made of paper. When in using, a user opens a lid 22, taking the almost center part A of a wrap film 11*a* with his/her fingers, drawing out a necessary amount, and then cutting it with a tooth-shaped cutting edge 24 fitted to a front sheet piece 23 that is bent downward at the front end of the lid 22.

In the conventional wrap film container having such structure, there are problems as follows.

(1) If the user carelessly tries to draw out the wrap film 11*a* with taking only the right or the left edge with his/her fingers, it cannot be well drawn out because the wrap film 11*a* in the upper layer is adhering to the wrap film 11*a* in the lower layer owing to the compatibility of the same materials (meaning that the same materials mutually fit well and apt to adhere to each other) due to the material of the wrap film 11 itself. Even if it can be drawn out, only one edge side is drawn out and the wrap film 11*a* wrinkles, so that it cannot be drawn out well in balance over the width. Thus the user must take the almost center part A with his/her fingers with confirming by his/her eyes every time and draw it out; it is troublesome.

(2) When in unusing, the tip of the cutting edge 24 has been exposed outside. Thus there is the possibility of careless injury. More particularly, it is dangerous for babies who have the habits of putting anything in his/her mouse and making it plaything of him/her; it lacks with PL measures.

(3) Since the user draws out and uses the wrap film 11*a* with taking with his/her fingers, if the hand is dirty, there is the possibility that the wrap film 11*a* and the container 20 are contaminated with unwanted bacteria; in nowadays that O-157 measures are cried for, it is not very preferable from the point of view of hygiene.

DISCLOSURE OF INVENTION

This invention has been done considering the above points, and aims to provide a device for supplying wrap film in which a wrap film can be drawn out easily and well in balance so as not to wrinkle, and the device is superior in safety and hygienic.

To solve the above problems, according to this invention, a wrap film container 1 having a box part (2, 3, 4, 5) having an opening 6 at the top and housing a wrap film body 11 formed by a rolled wrap film 11*a*, a sheetlike lid 7 fitted to the box part (2, 3, 4, 5) so as to freely openably cover the opening 6, and a cutting edge 10 fitted to the front end of the lid 7 or the front sheet 2 of the box part (2, 3, 4, 5), and in a state where the end of the wrap film 11*a* is drawn outward from a space between the opening 6 and the lid 7 via in front of the front sheet 2 of the box part (2, 3, 4, 5), by pressing the base of the end part against the cutting edge 10, for cutting off the end part from the wrap film body 11, and a sheetlike wrap film guide 13 in a state of peelably adhering to the end of the wrap film 11*a* in front of the front sheet 2 of the box part (2, 3, 4, 5), to be pulled out in one body with the above end part almost over the whole width, and capable of cutting off the end part by pressing the base part against the cutting edge 10, are provided.

Thereby, the wrap film 11*a* can be drawn out with the wrap film guide 13 easily and well in balance without forming wrinkles.

Furthermore, the end of the lid 7 is bent downward oppositely to the front sheet 2 of the box part (2, 3, 4, 5), and the cutting edge 10 is provided at the end of the above bending part, and at the same time, a freely-turnable cover sheet 12 for protection is provided in front of the above cutting edge 10.

Thereby, the cutting edge 10 can be protected so as not to be dangerous for a user.

The end of the lid 7 is bent downward oppositely to the front sheet 2 of the box part (2, 3, 4, 5), and the cutting edge 10 is fitted to the end of the above bending part, and at the same time, a recessed part "a" for protection in which the cutting edge 10 can be inserted from below is formed on the top surface of the wrap film guide 13, and when in unusing, the recessed part "a" of the wrap film guide 13 is inserted in the cutting edge 10 to prevent that the cutting edge 10 is exposed to the outside.

Thereby, the cutting edge 10 can be protected so as not to be dangerous for the user.

The cutting edge 10 is provided at the bottom end of the front sheet 2 of the box part (2, 3, 4, 5), and at the same time, the front end of the lid 7 is bent downward oppositely to the front sheet 2 of the box part (2, 3, 4, 5), and the bottom end is extended to the position in front of the cutting edge 10 and protecting the cutting edge 10.

Thereby, the cutting edge 10 can be protected so as not to be dangerous for the user.

The wrap film container 1 is formed by a transparent or a semi-transparent material, or an window is formed in a part of it. Thereby, the remaining amount of the wrap film body 11 contained inside can be confirmed.

The wrap film container 1 and/or the wrap film guide 13 is subjected to antimicrobial treatment.

Thereby, the wrap film 11*a* can be cut off hygienically.

According to this invention as the above, a device for supplying wrap film has wrap film guides 13, 13A, 13B, 13C and 13D capable of adhering to a wrap film 11*a*, to draw out the wrap film 11*a* with these wrap film guides 13, 13A, 13B, 13C and 13D. Thereby, the device in which the drawing-out and cutting work of the wrap film 11*a* is easy and a user can cut off the wrap film 11*a* without directly touching it and the wrap film 11*a* is not contaminated can be obtained.

Since the wrap film container 1 is made transparent or semitransparent or an window is provided, the remaining amount of the wrap film body 11 contained inside can be known in advance.

Since when in unusing the edge part 10*a* of the cutting edge 10 is covered with the cover sheet 12, or the cutting edge housing part "a" of the wrap film guide 13 and the recessed parts 13*a* and 13*b* of the wrap film guide 13A and 13B, injury of a user can be prevented and it is superior in safety.

Since the wrap film container 1 and the wrap film guides 13, 13A and 13B are subjected to antimicrobial treatment, it is hygienic.

Moreover, by providing two pieces of wrap film guides, if the first wrap film guide 13C is detached, the wrap film 11*a* automatically adheres to the surface of the second wrap film guide 13D set. The first and the second wrap film guides 13C and 13D can be alternately used. Furthermore, even if one of them is lost or broken, the wrap film 11*a* can be used with the other remaining.

BEST MODE FOR CARRYING OUT THE INVENTION

This invention will be described in detail with reference to the accompanying drawings.

(1) First Embodiment

Figure 1:
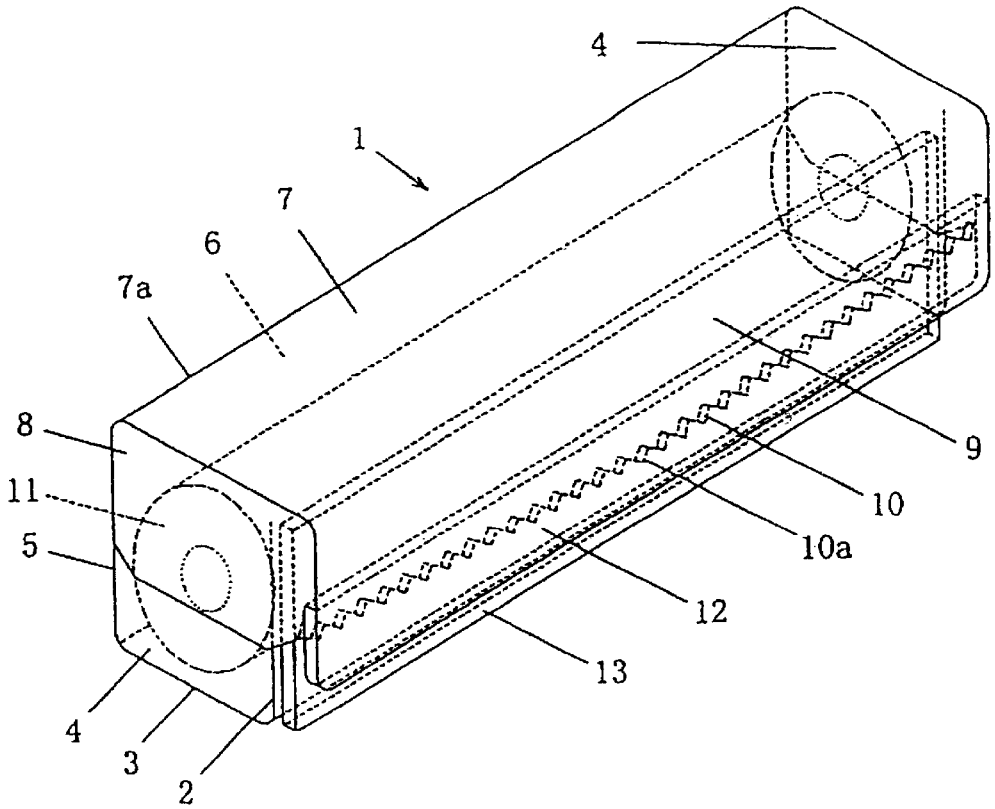
FIG. 1 is a perspective view showing a first embodiment of this invention.
Figure 2:
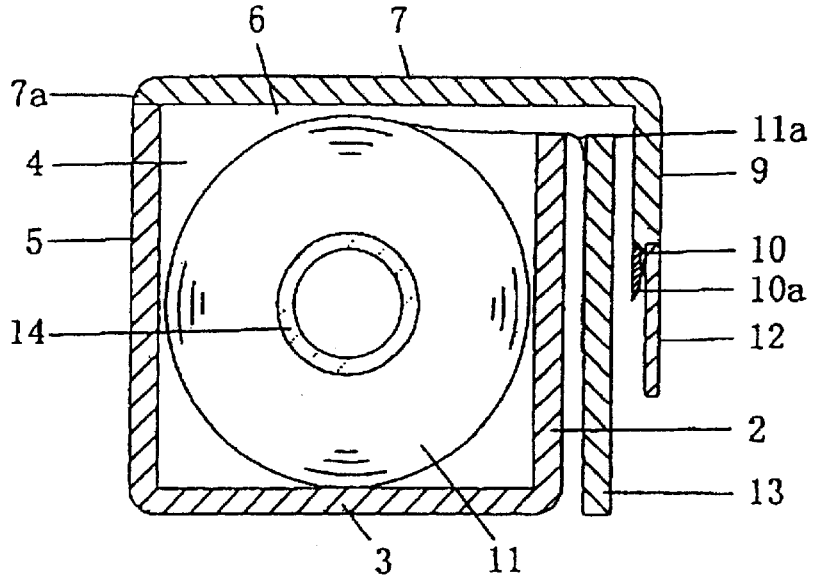
FIG. 2 is a side sectional view of FIG. 1.
Figure 3:
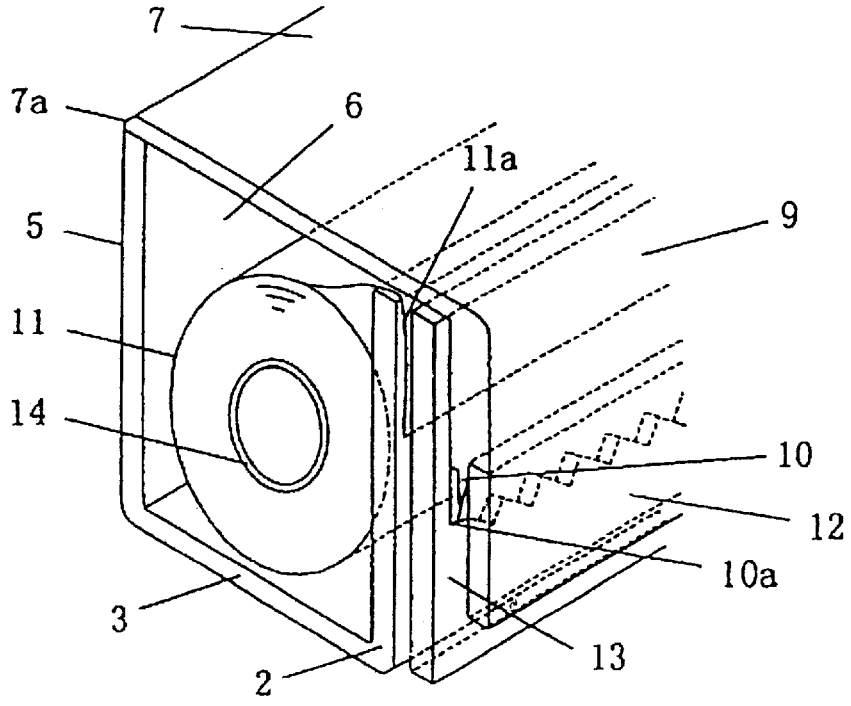
FIG. 3 is a sectional perspective view showing the internal structure of FIG. 1.

Referring to FIGS. 1 to 3, a reference numeral 1 designates a box-type wrap film container. This wrap film container 1 is formed in a box shape having an opening part 6 at the top by a front sheet 2, a bottom sheet 3, left and right side sheets 4 and a back sheet 5, and having a lid 7 of which the base end 7*a* is provided freely turnably to the back sheet 5. At the both ends in the longitudinal direction of the lid 7, side sheet pieces 8 which are located mutually oppositely on the outside of the side sheets 4 are provided respectively. At the front end of the lid 7, a front sheet piece 9 which is perpendicularly bent downward is provided. The dimension of this front sheet piece 9 extending downward is about half of the dimension of the front sheet 2.

The container having the above structure is formed for example by injection-molding synthetic resin. As the material of the synthetic resin, plastic such as epoxy resin, acrylic resin, etc. can be considered. Such molded products are more durable than conventional products made of paper. Therefore, when a wrap film 11*a* is used up, the container can be reused by refilling a new one. Here, adhering a piece of sheet into a box shape by using adhesive material or ultrasonic welding or the like is also possible, however, the molded products are more superior in labor and productivity.

A tooth-shaped cutting edge 10 is provided inside the front sheet piece 9 by integral molding. An edge part 10*a* at the end of this long and narrow beltlike cutting edge 10 is slightly exposed from the front end of the front sheet piece 9, and it can cut the wrap film 11*a* drawn out.

Figure 4:
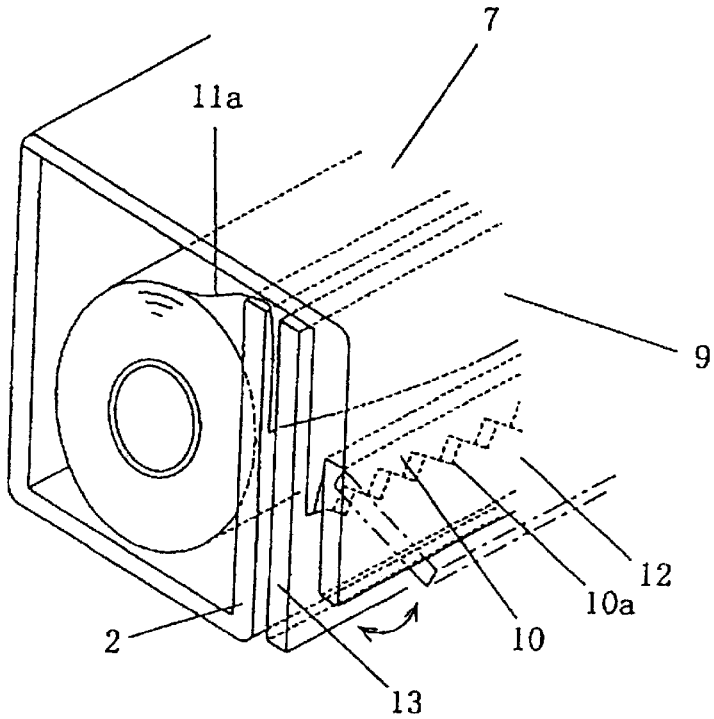
FIG. 4 is a sectional perspective view showing the internal structure of FIG. 1.

As shown in FIG. 4, at the lower front end of the front sheet piece 9, a cover sheet 12 which is freely turnable to the outside of the front sheet piece 9 and to cover the edge part 10*a* at the tip of the cutting edge that extends downward and the length dimension is short, is provided, to prevent that a user such as a little child or the like is not accidentally injured by the edge part 10*a* (to protect the edge part 10*a*).

The wrap film 11*a* has self-adhesion property that smooth surfaces adhere to each other. Accordingly, in the case where the surface of the wrap film container 1 is smooth as it adheres to the wrap film 11*a* and the material of the container is a material which is apt to adhere to the wrap film 11*a*, the wrap film 11*a* is hard to draw out. From this reason, it is preferable that such plastic is avoided as the material of the wrap film container 1. In the case where the wrap film 11*a* is a material apt to adhere, to prevent adhering, the inner surface of the container may be unevenly finished to reduce a contacting state of the wrap film 11*a* to the surface of the container, and lower the degree of contact. Of course, even if the surface is smooth, if it is a material hard to adhere, it may be used. As the material hard to adhere, for example a sheetlike object coated by a cation surface-active agent or fluoroplastic, or a sheetlike object made of a synthetic plastic can be applied.—

Moreover, a transparent or a semi-transparent material is used for the wrap film container 1. Therefore, the remaining amount of the wrap film body 11 contained in it can be seen.

Figure 5:
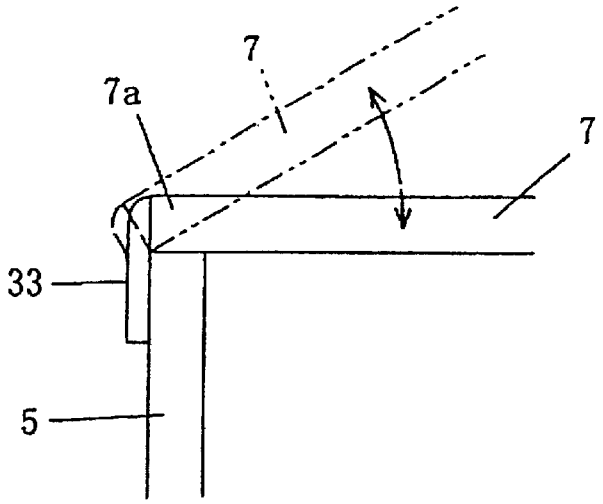
FIG. 5 is a schematic sectional view showing the movable structure of a lid to a back sheet piece.
Figure 6:
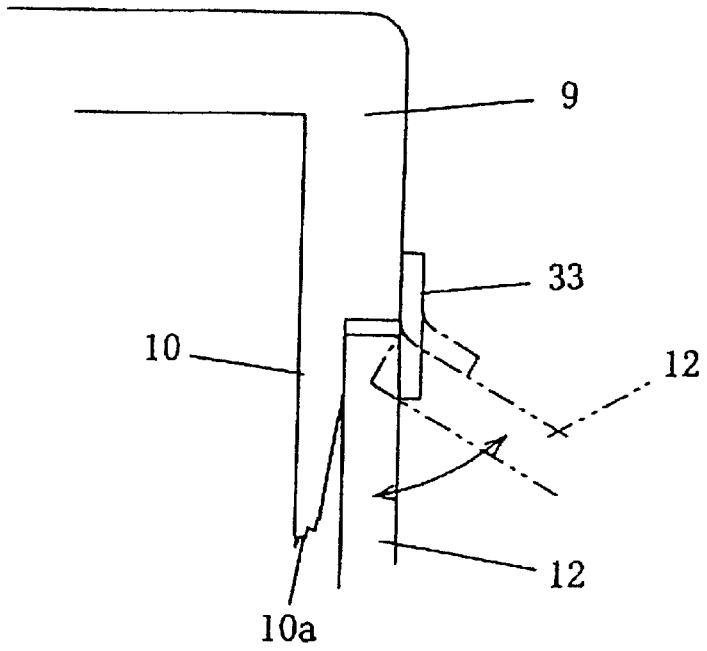
FIG. 6 is a schematic perspective view showing the movable structure of a cover sheet to a front sheet piece.
Figure 7:
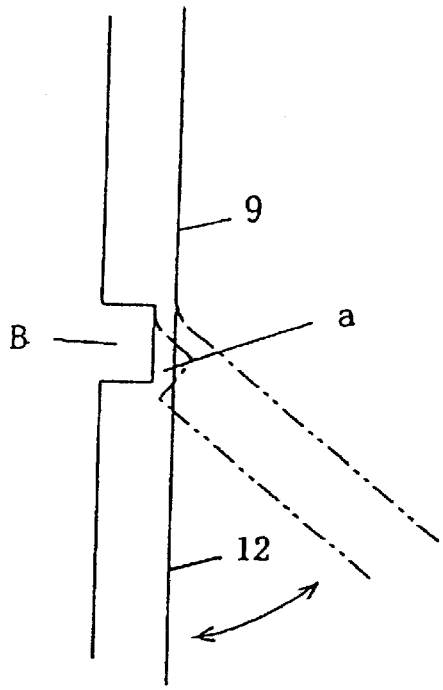
FIG. 7 is a schematic sectional view showing another example of the movable structure of FIG. 6.
Figure 8:
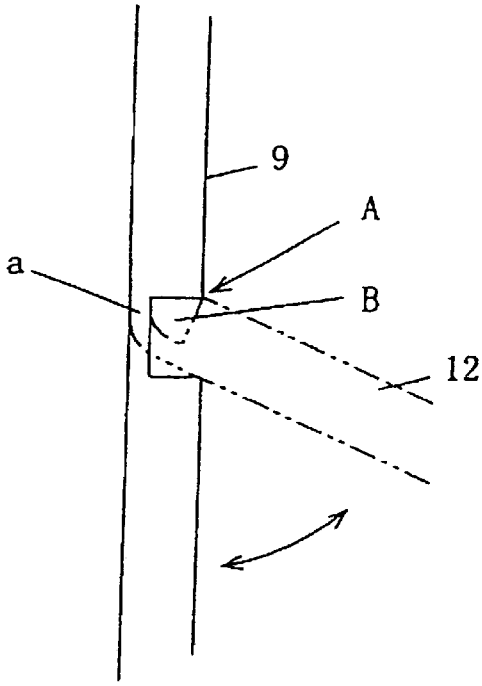
FIG. 8 is a schematic sectional view showing further example of the movable structure of FIG. 6.

Means for making the lid 7 freely turnable to the back sheet 5 or making the cover sheet 12 freely turnable to the front sheet piece 9 can be easily accomplished as shown in FIGS. 5 and 6, by connecting, for example with a tape 33 having warpability, the mutual members, that is, in this case, the lid 7 and the back sheet 5 or the front sheet piece 9 and the cover sheet 12, or as shown in FIG. 7, by forming, as a part to be a connecting part wanted to bend, a recessed part B on the rear side as a thin part "a" at the time of molding, because the resin having the warpability has flexibility. On the other hand, oppositely to FIG. 7, as shown in FIG. 8, if the recessed part B is formed on the surface, when the cover sheet 12 is bent to the front sheet piece 9, a mutual corner part A can function as a stopper as the bending range.—

Referring to FIGS. 1 to 4, a reference numeral 13 designates a wrap film guide. This wrap film guide 13 is formed in a sheet form having a thickness of almost 0.5 mm to 2 mm. When in unusing, it will be housed as pinched between the front sheet 2 and the front sheet piece 9. In this case, the wrap film guide 13 is never bulky since it is thin. The drawn-out wrap film 11*a* adheres to for example the upper end of the inner surface or the outer surface of this wrap film guide 13, and the upper end has been pinched between the front sheet 2 and the front sheet piece 9. Thereby, the wrap film guide 13 can be held without slipping off.

Note that, in the state shown in FIG. 2 and others, there is a space between the front sheet 2, the wrap film guide 13 and the front sheet piece 9. However, this drawing shows each member to make clearly understandable. In actual products, each member will be contacted.

Furthermore, since the wrap film guide 13 is formed by the synthetic resin and the surface is a smooth plane, it has compatibility with the wrap film 11*a* that has the self-adhesion property caused by the material. Also owing to the function of static electricity, it can easily adhere only by bringing close or contacting. Since also the surfaces of the front sheet 2 and the front sheet piece 9 are smooth planes, the wrap film guide 13 can be held by sandwiching between the front sheet 2 and the front sheet piece 9 by their adhesive power; it never falls even if shaking.

As the material of the wrap film guide 13, a material made of plastic such as acrylic resin, epoxy resin, etc. is used. Thus, the surface is smooth and it is apt to adhere to the wrap film 11*a*. More particularly, the acrylic resin is polyfunctional, the molecular amount is small, and at the time of heat-molding, the surface becomes a soft gloss-coated layer. Therefore, adhesive intensity to the wrap film 11*a* is good.

The wrap film body 11 has a circular section, is made of paper, and coiled around the outer circumference of a cylindrical core member 14 in a roll. This wrap film 11*a* is formed by a plastic film such as polyvinylidene chloride, polyvinyl chloride, polybutadiene, polyethylene, etc.

In case of this embodiment, antimicrobial treatment is subjected to the wrap film container 1 and the wrap film guide 13.

As an antimicrobial agent, metals such as silver, copper, zinc, tin, etc. and an organic compound or an inorganic compound including it can be used. Considering the safety and the durability of effectiveness, silver-related or copper-related inorganic antimicrobial agent is preferable. Furthermore, it is good to mix an antimicrobial agent by silver ions or copper ions into the aforementioned resin in a respect of low price. Or also it may be applied to the surface of a molded product.

As other antimicrobial agents, garlic, Japanese horseradish (wasabi), and catechin of Japanese green tea that are vegetable may be pulverized and mixed. The antimicrobial agent made from wasabi is known that it has a fine effect also on O-157. If using this antimicrobial agent, an antimicrobial component in wasabi gradually evaporates, and an increase in colon bacillus or the like can be inhibited.

Figure 9:
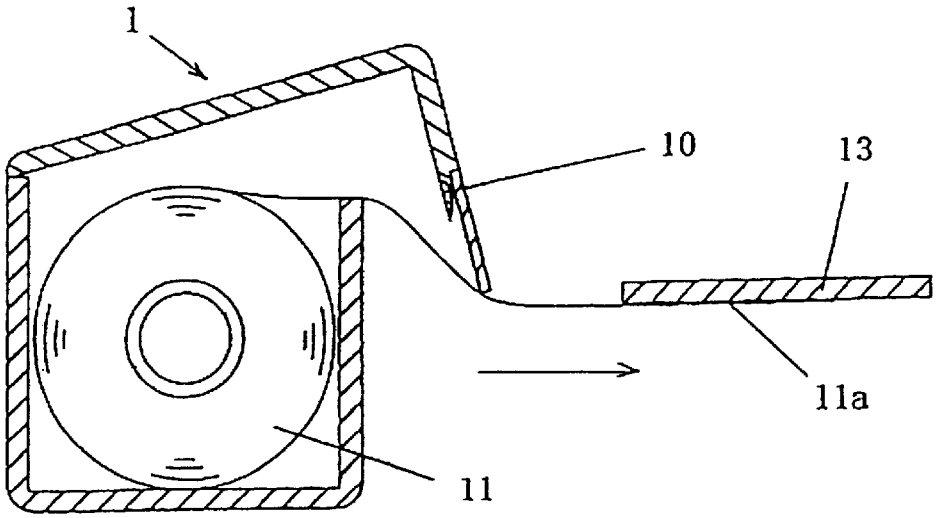
FIG. 9 is a schematic sectional view for explaining a using state.

According to the above structure, in using, in the state shown in FIGS. 1 to 3, by taking the lower end part of the wrap film guide 13 with fingers and pulling forward, a necessary amount of the wrap film 11*a* can be drawn out easily and well in balance as shown in FIG. 9, since the wrap film 11*a* is adhering to the end part over the whole longitudinal direction by the self-adhesion property.

Figure 10:
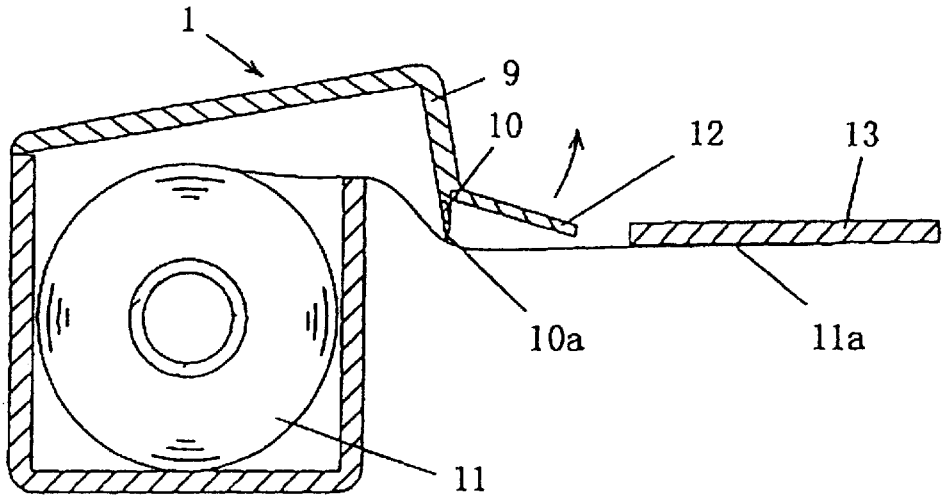
FIG. 10 is a schematic sectional view for explaining a using state.

In this case, as shown in FIG. 9, if the wrap film guide 13 is drawn out in the horizontal direction to the wrap film 11*a*, at this time, coefficient of friction between the wrap film guide 13 and the wrap film 11*a* becomes maximum. Therefore, the state where the wrap film 11*a* is adhering to the surface of the wrap film guide 13 can be maintained. Then, as shown in FIG. 10, by bringing up the cover sheet 12 and making the edge part 10*a* to expose, and pressing the wrap film 11*a* against the cutting edge 10, the wrap film 11*a* can be cut. In this manner, it never becomes obstructive at the time of cutting or never disturbs the cutting.

Figure 11:
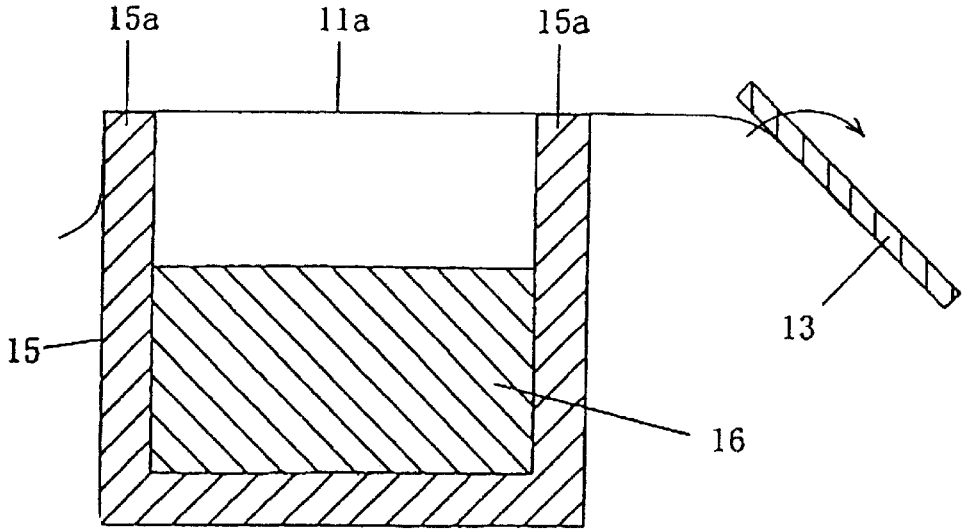
FIG. 11 is a schematic sectional view for explaining a using state.
Figure 22:
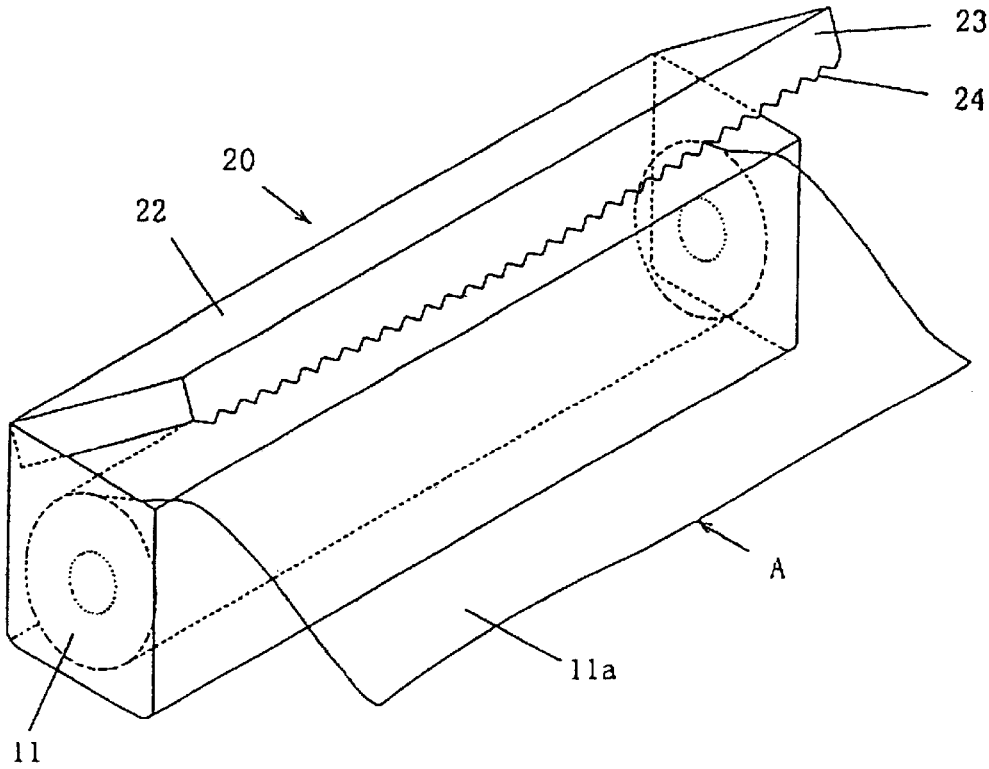
FIG. 22 (PRIOR ART)
FIG. 22 is a perspective view showing a conventional structure.

As shown in FIG. 11, by making the cut wrap film 11*a* adhere to the top surface on the outer circumference 15*a* at the upper opening part of a container 15 in that a food 16 or the like has been contained and turning the wrap film guide 13 for example as the lower part is a fulcrum as shown by an arrow, coefficient of friction gradually disappears and the cut wrap film 11*a* can be easily stripped off in a rapid motion without taking the wrap film 11*a* adhered to the inner surface with fingers.

Thereafter, the user makes the upper part of the wrap film guide 13 adhere to the end part of the wrap film 11*a* drawn out of the wrap film container 1. At this time, since the wrap film 11*a* is adhering to the front sheet 2, as shown in FIG. 1, the user may house the wrap film guide 13 between the front sheet 2 and the front sheet piece 9. Adhesion can be easily performed only by getting close the wrap film guide 13 to the wrap film 11*a* owing to static electricity. Or by making them contact to each other, they can be adhered to each other owing to the self-adhesion property of the wrap film and the compatibility of the wrap film guide 13.

According to the above structure, in the next use, the wrap film 11*a* can be drawn out again easily and well in balance from the wrap film container 1 by pulling forward the wrap film guide 13 again in the state where the wrap film 11*a* is adhering to the upper end of the wrap film guide 13.

As shown in FIGS. 1 to 3, since when in unusing the edge part 10*a* is covered with the cover sheet 12, it can be safely protected so that the user is never injured.

Furthermore, since the wrap film 11*a* is drawn out via the wrap film guide 13, occasion to directly touch the wrap film 11*a* becomes fewer than a conventional case, and it is hygienic.

Moreover, since the material of the wrap film container 1 and the wrap film guide 13 is strong and durable, if the wrap film is used up, they can be reused any number of times by separately refilling a new wrap film body 11; it is economy.

(2) Second Embodiment

Figure 12:
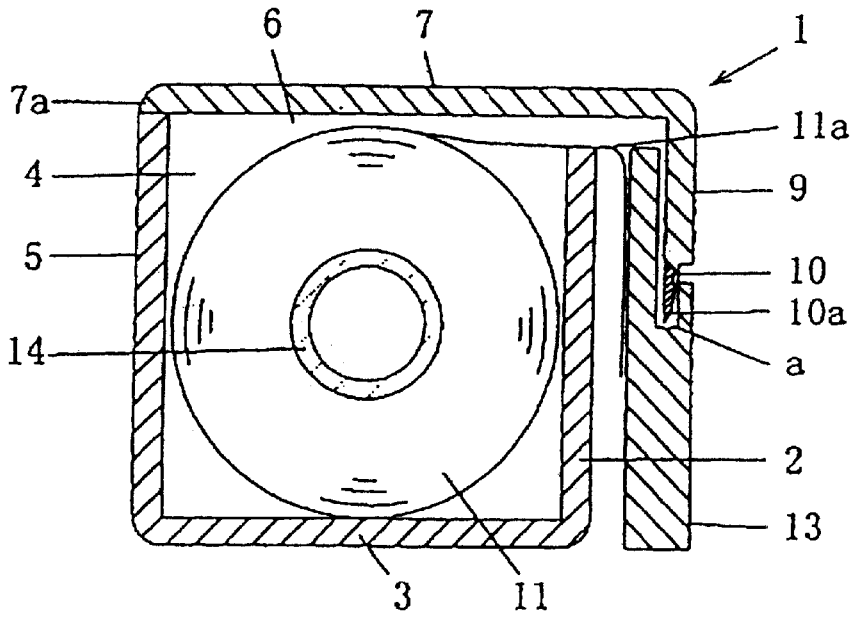
FIG. 12 is a side sectional view showing a second embodiment of this invention.
Figure 13:
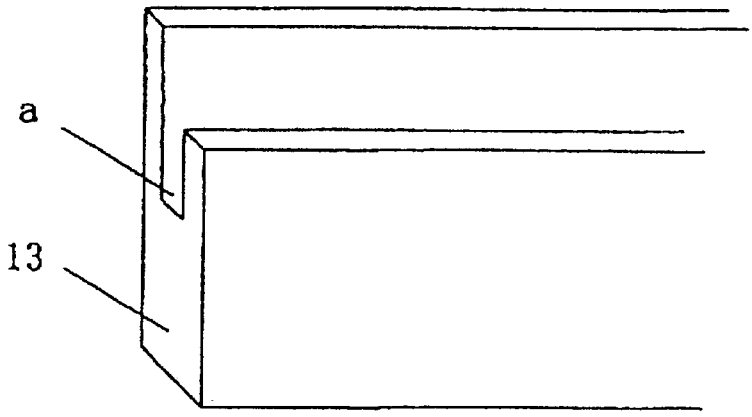
FIG. 13 is a partial perspective view showing a wrap film guide in FIG. 12.

FIGS. 12 and 13 show a second embodiment of this invention. This embodiment has characteristics that a part of a wrap film guide 13 is made thick and an almost-recessed cutting edge housing part "a" for housing a cutting edge 10 when the wrap film guide 13 is fitted to a wrap film container 1 is formed.

Therefore, even if a cover sheet 12 is not provided as the case of FIGS. 1 to 4, the cutting edge 10 is never exposed to the outside. Thus the cutting edge 10 can be protected so that the user is never injured.

(3) Third Embodiment

Figure 14:
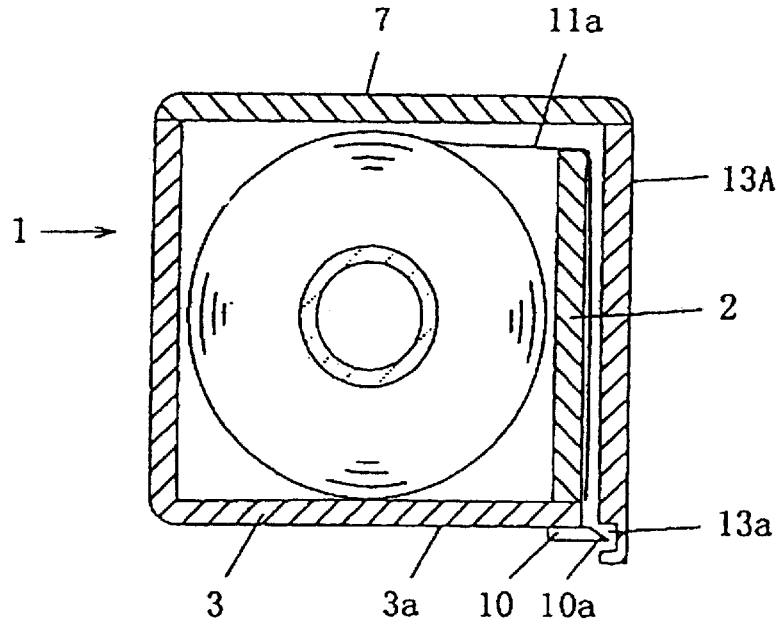
FIG. 14 is a side sectional view showing a third embodiment of this invention.

FIG. 14 shows a third embodiment of this invention. This case has characteristics in a point that the front surface of a wrap film container 1 can be covered with a wrap film guide 13A and a cutting edge 10 is provided at the front end part 3*a* of a bottom sheet 3.

Here, FIG. 14 shows the mutual relationship of members so that there are spaces on the both sides of a wrap film 11*a*, however, this is only to intelligibly show in the drawing. Practically, the wrap film 11*a* will be adhered to the inner surface of the wrap film guide 13A by the self-adhesion property of the wrap film 11*a*, and the wrap film 11*a* will be also adhered to the outside of a front sheet 2 provided in standing at the front end of the top surface of the bottom sheet 3 by the self-adhesion property. Thus it is light, and the wrap film guide 13A in a thin sheet form can be held in front of the wrap film container 1.

On the other hand, a recessed part 13*a* in a notch form is formed at the lower inside of the wrap film guide 13A. The edge part 10*a* of the cutting edge 10 will be housed in this part, so that when in unusing the edge part 10*a* is protected so as not to be exposed to the outside.

According to the structure of FIG. 14, when in unusing, the wrap film guide 13A is adhered to the wrap film 11*a* drawn out in front of the front sheet 2 by adhesive power caused between them. At this time, the cutting edge 10 is housed in the recessed part 13*a* provided at the lower inside of the wrap film guide 13A, and is protected to prevent from injuring the user.

In this state, if the user takes the wrap film guide 13A with his/her fingers and pulls forward, the end of the wrap film 11*a* adhering to the wrap film guide 13 is pulled forward, so that the wrap film 11*a* is drawn out of the wrap film container 1. Thereafter, if the user moves the wrap film guide 13A under the bottom sheet 3, the wrap film 11*a* is pressed against the cutting edge 10 and cut.

At this time, since the wrap film 11*a* drawn out is remaining in front of the front sheet 2, if the user detaches the cut wrap and adhering the wrap film guide 13A, it returns to the aforementioned unusing state.

Thereby, the same effect as the case described above with reference to FIGS. 1 to 4 can be obtained.

(4) Fourth Embodiment

Figure 15:
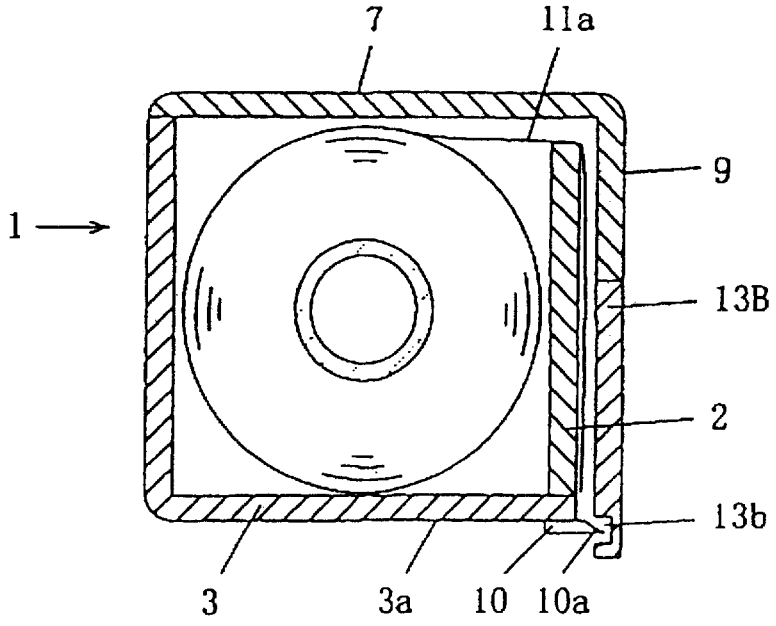
FIG. 15 is a side sectional view showing a fourth embodiment of this invention.

FIG. 15 shows a fourth embodiment of this invention. In this case, a front sheet piece 9 which extends downward is provided at the front of a lid 7. The lower end of this front sheet piece 9 extends to the almost half of the height of a front sheet 2. Even if a wrap film guide 13B is detached, there is the front sheet piece 9 in front of a space formed between the upper end of the front sheet 2 and the inner surface of the lid 7 opposite to this to draw out a wrap film 11*a*.

According to the above structure, the user can perform the cutting work of the wrap film 11*a* in the same manner described above with reference to FIG. 14. Therefore, dust can be hard to enter the inside of a wrap film container 1 owing to the front sheet piece 9 and the front sheet 2. On the other hand, the upper end of a wrap film guide 13B can be held freely detachably further readily.

(5) Fifth Embodiment

FIGS. 16 to 21 show a fifth embodiment of this invention. In this case, two pieces of wrap film guides 13C and 13D are overlapped each other and used in a wrap film container 1.

Figure 16:
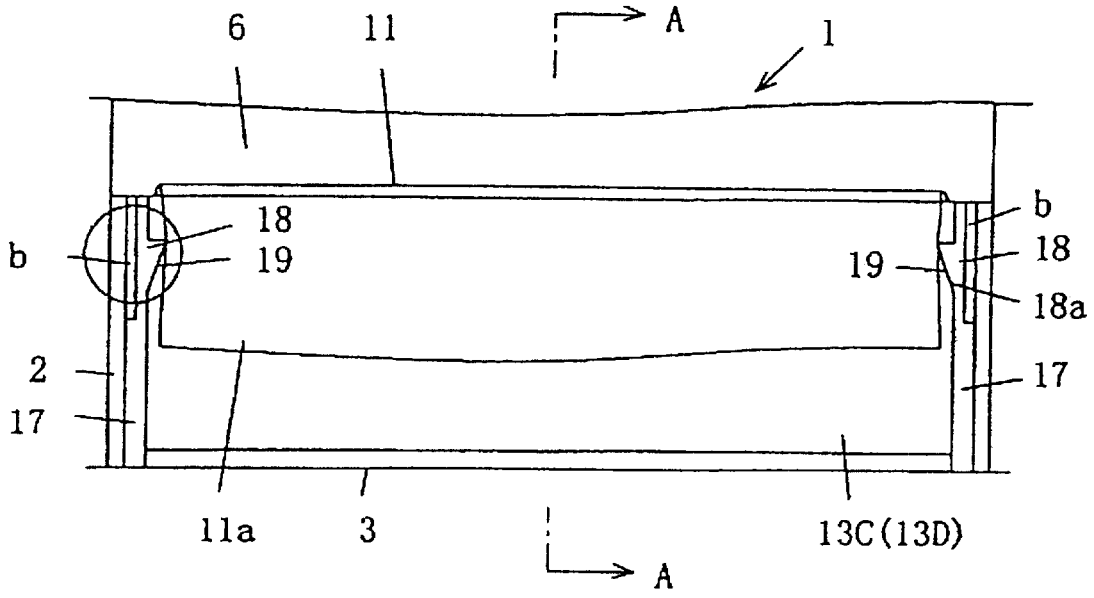
FIG. 16 is a front view showing a fifth embodiment of this invention.
Figure 17:
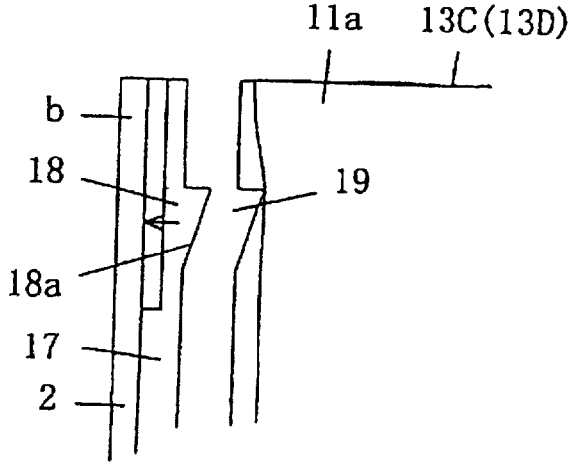
FIG. 17 is an enlarged sectional view showing the structure of a part C circled in FIG. 16.

In this case, as shown in FIGS. 16 and 17, two bars of ribs 17 (formed by a synthetic resin material) which extend in the vertical direction are respectively provided at the both side parts of a front sheet 2. A hook part 18 having a taper part 18*a* that can be engaged with the first and the second wrap film guides 13C and 13D are projectively provided in a triangular toward the inside for example at the upper insides of the respective ribs 17. On the reverse side (i.e. the outside) of the hook parts 18, notch parts "b" are formed, so that the hook parts 18 can be warped to the outside.

At the both ends of the respective first and second wrap film guides 13C and 13D, notches 19 each of which has a taper part 19*a* that can be engaged with the hook part 18 are formed so as to be recessed in a triangular shape toward the inside almost correspondingly to the hook parts 18. Thereby, the first and the second wrap film guides 13C and 13D can be held at the front of the wrap film container 1.

When the two pieces of wrap film guides 13C and 13D are overlapped each other, the first wrap film guide 13C or 13D located in the outside (in case of FIG. 8, it is 13C) is adhered to the front of the wrap film 11*a*.

According to the above structure, when in using, referring to FIGS. 16 and 17, a user first takes the first wrap film guide 13C located in the outside, and moving it forward so that the notches 19 are released from the hook parts 18. Then, as shown in FIG. 19, the user draws out a predetermined amount of the wrap film 11*a* from the wrap film container 1, pressing the base end of the above drawn-out wrap film 11*a* against a cutting edge 10*a*, and cutting the end part of the wrap film 11*a*.

Figure 19:
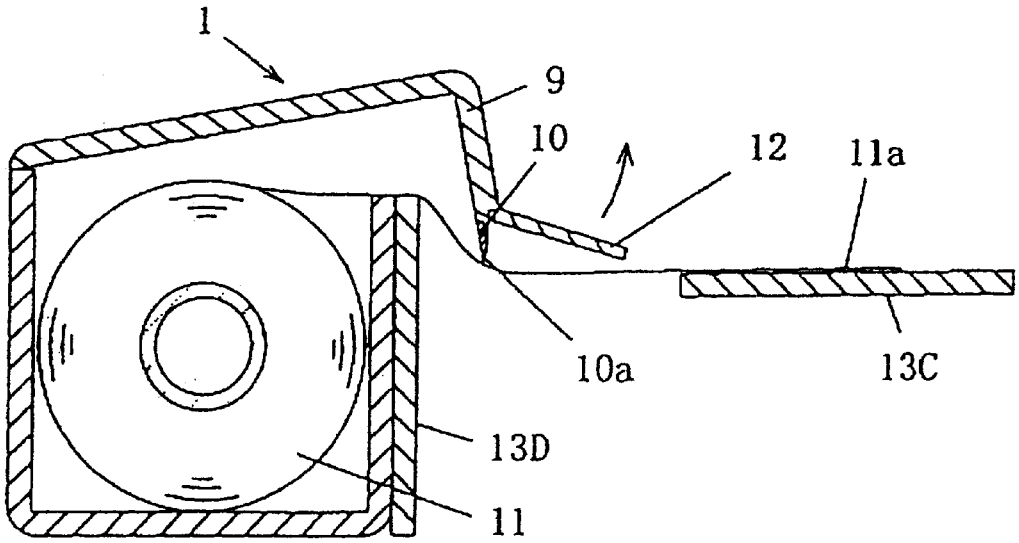
FIG. 19 is a side sectional view for explaining the change of using state following a state in FIG. 18.
Figure 20:
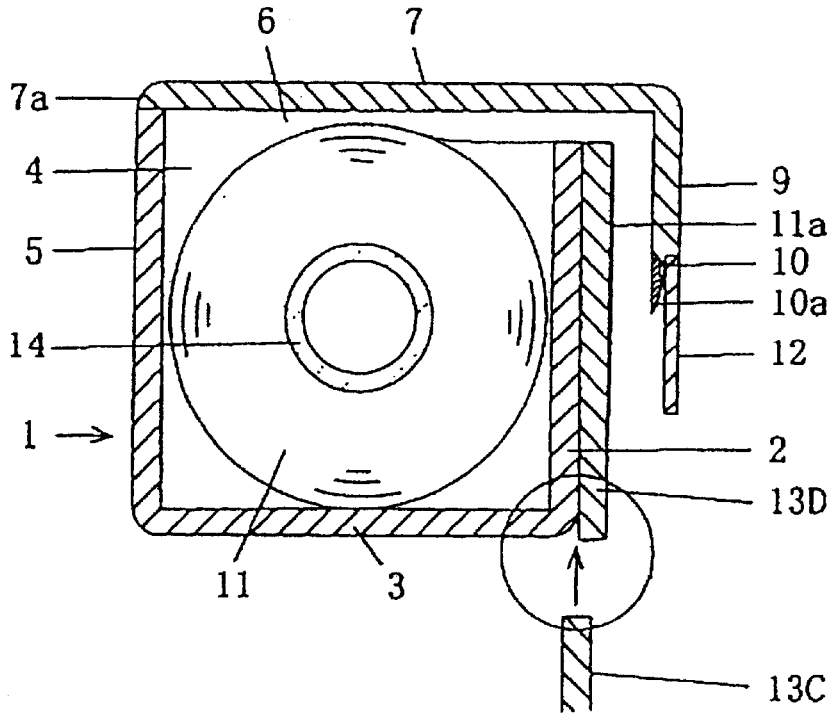
FIG. 20 is a side sectional view for explaining the change of using state following the state in FIG. 18.

In this state, as shown in FIGS. 19 and 20, the front surface of the second wrap film guide 13D that was on the inner side is pulled out from the wrap film container 1 and adhered to the wrap film 11*a* remaining without cutting.

Thereafter, as shown in FIG. 20, the first wrap film guide 13C will be pushed into a space between the front sheet 2 and the second wrap film guide 13D by the user as shown by an arrow. In this case, since the notches "b" have been formed on the reverse side of the hook parts 18 of the ribs 17, as shown by an arrow in FIG. 17, the hook parts 18 warp to the outside, so that the wrap film guide 13C can be easily pushed into. Thus the notches 19 can be engaged with the hook parts 18 at the inside of the second wrap film guide 13D together with this.

Figure 18:
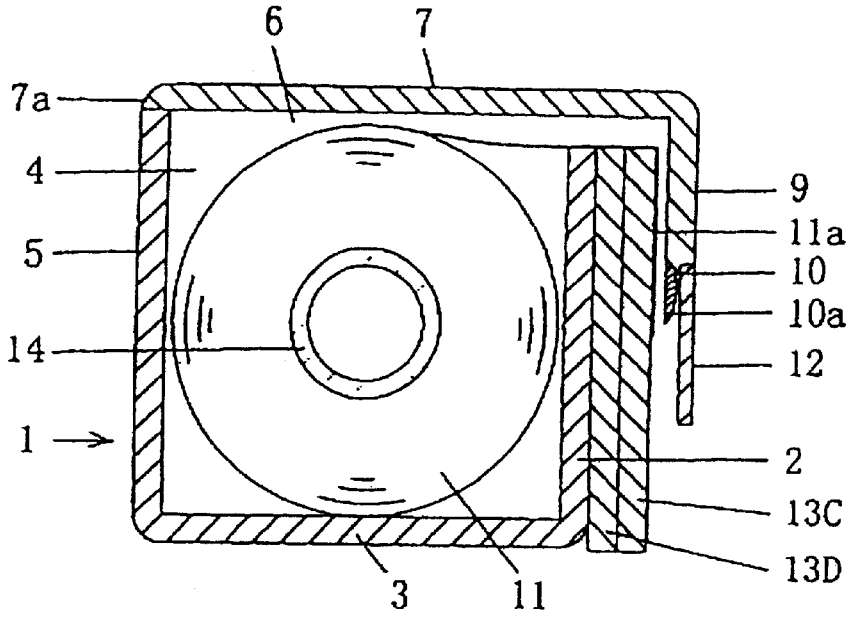
FIG. 18 is a side sectional view taken by a line A—A in FIG. 16.

At this time, the two pieces of film guides 13C and 13D, overlapped each other can be set in the same manner as FIGS. 16 and 18 except for that the positional relationship of the first and the second wrap film guides 13C and 13D has been opposite.

When the wrap film is used next time, the second wrap film guide 13D located in the outside is moved forward from the wrap film container (1), and the same procedure is repeated hereafter.

According to the structure in FIGS. 16 to 20, since the user alternately uses the two pieces of wrap film guides 13C and 13D, the drawing-out and cutting work of the wrap film 11*a* can be further easily and surely performed.

(6) Sixth Embodiment

In the aforementioned embodiments, as the wrap film guide 13, the synthetic resin which is a material apt to adhere to the wrap film 11*a* has used to obtain the adhesive power for making the wrap film guide 13 adhere to the wrap film 11*a*. However, instead of or additionally to this, a temporal stopper member having an adhesive power to the wrap film 11*a* may be provided on the surface of the wrap film guide 13.

Specifically, to a wrap film guide 13 formed by a material of which the property of adhering to the wrap film 11*a* is large or a wrap film guide 13 formed by a material of which the property of adhering to the wrap film 11*a* is small, if for example bridging hardening varnish is partially applied and an applied layer in a flat thin film (not shown) is provided on the whole surface or in a suitable part of the wrap film guide 13, the adhesive power to the wrap film 11*a* is improved. That is, since this applied layer is solid and smooth varnished layer, the adhesive property to the wrap film 11*a* is improved.

As this kind of varnish, for example a material in which acrylic denatured resin such as epoxy-related acrylate, polyester-related acrylate, etc. is base range, or unsaturated polyester resin (UP) may be used.

Instead of the varnished layer, even if a sticking layer made of a composition of resin containing chloroethene group is provided, adhering and peeling-off can be repeated and the same effect can be obtained. However, it is desirable to avoid a thing related to chlorine as you can from dioxin measures.

If using the temporary stopper member as above, as the material of the wrap film guide 13 to which the wrap film 11*a* is hard to adhere, also cardboard as a conventional case, synthetic plastic, a thin plate made of for example, magnesium metal, ceramic, etc. can be used.

(7) Other Embodiments (i) Referring to FIGS. 1 to 3, the side sheet pieces 8 of the lid 7 may be omitted provided that the airtightness of the wrap film container 1 when the lid 7 is closed, and the intensity of the lid 7 and the front sheet piece 9 are high.

(ii) In the aforementioned embodiments, the cutting edge 10 has molded in one body with the wrap film container 1. However, instead of this, a cutting edge made of a thin metal plate may be fitted to a wrap film container 1 by a bonding agent or a fixing member.

(iii) In the aforementioned embodiments, as the wrap film container 1, the material being transparent or semi-transparent resin has wholly used, so that the remaining amount of the contained wrap film body 11 can be confirmed. However, instead of this, provided that the remaining amount of the contained wrap film body 11 can be confirmed, it may be partial, for example, the side sheet 4 may be provided at only one side. Besides, for example an window (not shown) may be formed on the side sheet 4, the lid 7, etc., to see the inside, and the other part may be opaque and made a display part to mention an explanation of the product or the like. In this case, as a material in this case, for example colored plastic can be considered.

Besides, instead of this, as the material of the wrap film container 1, cardboard, a thin plate of synthetic plastic, magnesium alloy, a ceramic thin plate may be used.

(iv) In the aforementioned embodiments, in the case where also the members other than the 61 wrap film guide 13 have the adhesion property to the wrap film 11*a*, in the same manner as the aforementioned sixth embodiment, a temporal stopper member may be provided on the wrap film guide 13 to determine the adhesive power as the entire wrap film guide 13 including the adhesive power of this temporary stopper member.

For instance, when the wrap film 11*a* drawn out of the wrap film body 11 in the wrap film container 1 by means of the wrap film guide 13 is cut with the cutting edge 10, there is the possibility that the end part of the wrap film 11*a* once drawn out is pulled back into the wrap film container 1 when the wrap film body 11 falls in the wrap film container 1 (because it loses the drawing power by cutting) from the state where the wrap film body 11 has been drawn to the opening for drawing out as a whole.

To prevent this, it can be considered that a draw-back stopper member having adhesive power to the wrap film 11*a* is provided near the opening for drawing out the wrap film 11*a* (for example at the top end of the front sheet 2 and/or on the inside of the front sheet piece 9).

In such case, even if the user tries to draw out the wrap film 11*a* by taking out the wrap film guide 13 from the wrap film container 1, the wrap film 11*a* adheres to the draw-back stopper members of the front sheet 2 and the front sheet piece 9. Thus the wrap film 11*a* cannot be smoothly drawn out.

In this case, mutual adhesive power may be controlled by reducing the area of the draw-back stopper member provided on the front sheet 2 or the front sheet piece 9 to weaken the adhesive power to the wrap film 11*a*, and by increasing the area of the temporary stopper member on the wrap film guide 13 to increase the adhesive power.

Moreover, for example in the case where the same material is selected for the wrap film guide 13, the front sheet piece 9 and the front sheet 2, for instance, a part of or the whole inner surfaces of the front sheet 2 and the front sheet piece 9 may be unevenly formed to make the contacting area to the wrap film 11*a* smaller than the wrap film guide 13.

(v) In case of FIGS. 14 and 15, when in unusing, the wrap film guide 13A is held by the wrap film container 1 owing to the adhesive power to the wrap film 11*a* drawn out in front of the front sheet 2. However, to increase the holding power to the wrap film 11*a*, a holding temporal stopper member may be provided on the surface of the wrap film guide 13A.

On the other hand, a holding power for holding the wrap film guide 13A may be provided in the bottom sheet 3. As the holding part, for example it can make the structure that the wrap film guide 13A will be fitted into the end of the inner surface of the lid 7.

(vi) In case of FIGS. 14 and 15, the edge part 10*a* has provided at the front end of the wrap film container 1 (more particularly, the under surface of the bottom sheet 3). However, instead of this, the main body part may be embedded in the bottom sheet 3, and the edge part 10*a* may be projected to the outside. Or the edge part 10*a* may be put between the top surface of the bottom sheet 3 and the under surface of the front sheet 2.

Figure 21:
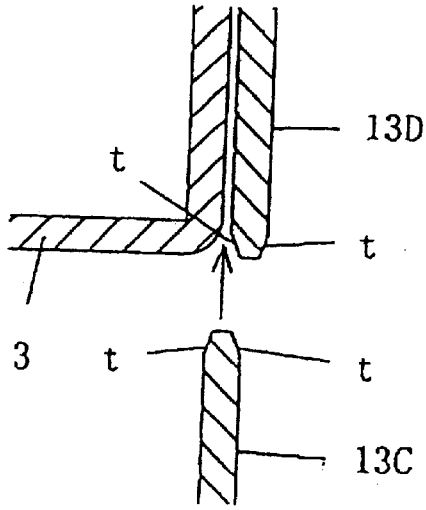
FIG. 21 is a side sectional view showing another embodiment than FIG. 20.

(vii) Similarly to the case of FIG. 20, in the case where the two pieces of wrap film guides 13C and 13D are used with overlapping, as shown in FIG. 21, if the corners of the tip part of the wrap film guides 13C and 13D have been previously formed in a shape as chamfered, when the first wrap film guide 13C after using (or the second wrap film guide 13D) is pushed into, the respective taper parts "t" at the top end and the bottom end of the wrap film guides 13C and 13D can be mutually inserted. Therefore, the insertion of the wrap film guide 13C (or 13D) into the wrap film guide 13D (or 13C) from the outside can be further easily performed.

INDUSTRIAL APPLICABILITY

This invention is applicable to a device for supplying wrap film by drawing out a wrap film for necessary amount from a container and cutting off.

What is claimed is:

1. A device for supplying a wrap film comprising:

a wrap film container including a box having an opening at a top thereof and containing a wrap film body formed by rolling a wrap film, a lid attached to said box to cover said opening in a freely openable manner and a cutting edge fitted to the front of said box, such that an end of said wrap film is drawn out through a space between said opening and said lid, past a front portion of said box, whereby said end is pressed against said cutting edge to cut off said end from said wrap film body;

a wrap film guide peelably adhering to said end of said wrap film and disposed on the front portion of said box, permitting said end to be drawn out over most of the width of said box, to be cut off by pressing said end against said cutting edge; and a concave part on said wrap film guide facing said cutting edge to cover said cutting edge by fitting said concave part to said cutting edge so that said cutting edge is not exposed when not is use.

2. A device for supplying a wrap film comprising:

a wrap film container including a box having an opening at a top thereof and containing a wrap film body formed by rolling a wrap film, lid attached to said box to cover said opening in a freely openable manner and a cutting edge attached to an end of said lid, such that an end of said wrap film is drawn out through a space between said opening and said lid, past a front portion of said box, whereby said end is pressed against said cutting edge to cut off said end from said wrap film body;

a wrap film guide peelably adhering to said end of said wrap film and disposed on the front portion of said box, permitting said end to be drawn out over most of the width of said box, to be cut off by pressing said end against said cutting edge; and a concave cutting edge containing part formed at a top surface of said wrap film guide to cover said cutting edge by fitting said cutting edge containing part to said cutting edge so that said cutting edge is not exposed when not is use.

3. A wrap film guide formed as a sheet for a wrap film container that contains a wrap film body rolled therein, such that, when used, the wrap film guide permits an end of said wrap film to be pulled out of said container while adhering to the guide, and then to be cut off by pressing said end against a cutting edge attached to said container, and a concave part formed on said guide facing said cutting edge to cover said cutting edge by fitting said concave part to said cutting edge so that said cutting edge is not exposed when not is use.

* * * * *